US005162608A

United States Patent [19]

Matsuda et al.

[11] Patent Number: 5,162,608

[45] Date of Patent: Nov. 10, 1992

[54] DEVELOPING PROCESS AND APPARATUS USING A MAGNETIC ROLLER INCLUDING A SLEEVE HAVING AN ELECTRET LAYER

[75] Inventors: Masanori Matsuda, Tokyo; Takeshi Hori, Yokohama, both of Japan

[73] Assignee: Mita Industrial Co., Ltd., Osaka, Japan

[21] Appl. No.: 686,437

[22] Filed: Apr. 17, 1991

[30] Foreign Application Priority Data

Apr. 17, 1990 [JP] Japan ..... 2-99393
Apr. 20, 1990 [JP] Japan ..... 2-103009

[51] Int. Cl.[5] ..... G03G 15/09

[52] U.S. Cl. ..... 118/657; 355/245; 355/251; 355/253; 430/122

[58] Field of Search ..... 355/245, 251, 252, 253, 355/270, 305, 261; 118/644, 657, 653, 658, 647; 430/122

[56] References Cited

U.S. PATENT DOCUMENTS 4,021,106 5/1977 Gaynor ..... 355/200
4,754,304 6/1988 Ohashi et al. ..... 355/270
4,935,785 6/1990 Wildi et al. ..... 355/290
4,998,141 3/1991 Altman ..... 355/246

FOREIGN PATENT DOCUMENTS 0228276 12/1984 Japan ..... 355/305
0091672 3/1990 Japan .

*Primary Examiner*—Joan H. Pendegrass
*Assistant Examiner*—J. E. Barlow, Jr.
*Attorney, Agent, or Firm*—Sherman and Shalloway

[57] ABSTRACT

A developing process for supplying a developer to a support having an electrostatic latent image thereon by using a developer-delivering member having an electret layer and carrying out the development so that the effective fog-controlling field intensity ratio (A) defined by the following formula:

$$A = \frac{E_S - E_B}{E_L - E_B}$$

wherein $E_L$ represents the surface potential of the latent image area in the support having the electrostatic latent image area, $E_B$ represents the surface potential of the non-image are and $E_S$ represents the surface potential of the electret layer, is in the range of from 0.01 to 0.6.

According to this process, an image having a high density with no fog can be formed without applying a developing bias voltage.

19 Claims, 7 Drawing Sheets

DEVELOPING PROCESS AND APPARATUS USING A MAGNETIC ROLLER INCLUDING A SLEEVE HAVING AN ELECTRET LAYER

BACKGROUND OF THE INVENTION (1) Field of the Invention

The present invention relates to an electrophotographic developing process and apparatus utilizing an electret. More particularly, the present invention relates to a developing process and apparatus capable of forming a high-density image while preventing occurrence of background fogging.

(2) Description of the Related Art

In a developing apparatus of a commercial electrophotographic copying machine, the magnetic brush developing process is widely adopted For example, a two-component type developer consisting of a mixture of a magnetic carrier and an electroscopic toner or a one-component type developer consisting of a powder having magnetic properties is electrically charged, a magnetic brush of the developer is formed on a developer-delivering member (sleeve) having magnets disposed in the interior thereof, the magnetic brush is moved to the surface of a photosensitive material having an electrostatic latent image, and the surface is brought into sliding contact with the magnetic brush under a bias electric field to form an image.

Furthermore, the developing process using a non-magnetic one-component type developer has already been proposed, and for example, Japanese Unexamined Patent Publication No. 60-136773 proposes a developing apparatus for visualizing a latent image by bringing a developer into contact with or access to a latent image support, in which a developer-delivering member supporting the developer on the surface and delivering the developer along a course including the visualizing region is formed of an electret. In this apparatus, the transfer of the developer is controlled by applying a direct current or alternating current bias voltage between the developer-delivering member and latent image support.

In the conventional developing process, electric adhesion of the developer (toner) to the latent image area (charged area) and prevention of adhesion of the developer (toner) to the non-latent-image area are mainly accomplished by applying a bias voltage between the developer-delivering member and the photosensitive material. In order to obtain the applied bias voltage at the developing step, it is necessary that the developer-delivering member should be disposed in a state electrically insulated from the machine frame. The machine frame is grounded and electricity is applied to the developer-delivering member in this state. However, this is very difficult to accomplish and problems occur not only in the design of the apparatus but also in its operation.

In fact, in practical copying machines, a trouble of insufficient application of the bias voltage is caused by insufficient application of electricity to the developer-delivering member, resulting in occurrence of such troubles as background fogging. In order to prevent occurrence of such troubles, repairing and inspection of surrounding electric parts and members should be performed periodically and indeterminately, which is a serious disadvantage in the maintenance.

Moreover, special parts are necessary for disposing the developer-delivering means in the electrically insulated state so as to apply the above-mentioned bias voltage, and also complicated designing is necessary and transformer parts and other electric circuit parts become necessary. Accordingly, the cost of the apparatus increases and the space for the apparatus increases, and also the weight of the apparatus increases. Thus, problems arise with respect to the hardware.

SUMMARY OF THE INVENTION

It is a primary object of the present invention to provide an electrophotographic developing process and apparatus in which occurrence of background fogging by insufficient application of the bias voltage can be prevented and a sharp image having a high density can be stably formed.

Another object of the present invention is to provide a magnetic brush developing process and apparatus in which a high-density image having no fog can be formed by using a magnetic developer without application of any bias voltage.

Still another object of the present invention is to provide a developing process and apparatus in which a good image can be formed by using a developer-delivering member having an electret layer and using a magnetic or non-magnetic developer.

In accordance with one aspect of the present invention, there is provided an electrophotographic developing process comprising supplying a magnetic developer to a developer-delivering member having magnets disposed in the interior thereof and also having on the surface thereof an electret layer having a polarity reverse to the polarity of developer particles, to form a magnetic brush of the magnetic developer, and bringing the magnetic brush into contact with a support having an electrostatic latent image thereon, to effect the development of the electrostatic latent image.

In accordance with another aspect of the present invention, there is provided an electrophotographic developing process comprising electrically charging a non-magnetic developer, supplying the charged developer to a developer-delivering member having an electret layer having a polarity reverse to the charge polarity of the developer, and supplying the developer to a support having an electrostatic latent image to develop the electrostatic latent image, wherein the development is carried out so that the effective fog-controlling field intensity ratio (A) defined by the following formula:

$$A = \frac{E_S - E_B}{E_L - E_B}$$

wherein $E_L$ represents the surface potential of the latent image area in the support having the electrostatic latent image area, $E_B$ represents the surface potential of the non-image area and $E_S$ represents the surface potential of the electret layer, is in the range of from 0.01 to 0.6.

In accordance with still another aspect of the present invention, where is provided in developing apparatus comprising a support for supporting an electrostatic image thereon, a mechanism for electrically charging a powdery developer and a developer-delivering member for supporting the charged powdery developer thereon and supplying the powdery developer to said support, wherein the developer-delivering member has an electret dielectric layer at least on the surface thereof, and the change density of the electret dielectric layer is adjusted so that the fog-controlling charge density ratio (D) defined by the following formula:

$$D = \frac{\delta - \delta_B}{\delta_L - \delta}$$

wherein $\delta$ represents the charge density of the electret dielectric layer, $\delta_B$ represents the charge density of the non-image area of said support and $\delta_L$ represents the charge density of the image area of said support, is in the range of from 0.01 to 2.0.

In accordance with still another aspect of the present invention, there is provided an electrophotographic developing apparatus comprising a support for supporting an electrostatic image, a mechanism for electrically charging a powdery developer and a developer-delivering member for supporting the charged powdery developer thereon and applying the charged powdery developer to said support, wherein the developer-delivering member has a laminate structure comprising an electret dielectric layer and a protecting dielectric layer formed on the surface of the electret dielectric layer.

DETAILED DESCRIPTION OF THE INVENTION

Developing Process

In principle, according to the developing process of the present invention, a high-density image with no background fogging can be formed over a period of a long time by the non-bias-voltage magnetic brush development. Of course, the present invention can also be applied to the bias voltage-applying magnetic brush development process. It should be understood that in the latter case, the additionally applied voltage may be one for the adjustment.

As the magnetic developer, there can be used not only a two-component type developer comprising a magnetic carrier and an electroscopic toner but also a one-component type magnetic toner comprising a magnetic powder. In the instant specification, in case of the two-component type developer, toner particles are meant by "developer particles".

In the present invention, a magnetic brush is formed by using a developer-delivering member having magnets in the interior and an electret layer on the surface. The magnets should be disposed in the interior of the delivering member so as to deliver the developer in the form of magnetic brushes and bring the magnetic brushes into contact with an electrostatic latent image support such as a photosensitive material. The electret is a dielectric material having a permanent electric polarization. In the present invention, this electret is arranged on the developer-delivering member so that the polarity of the outer surface of the electret is reverse to the charge polarity of the developer particles. Both of the magnetic attracting force and the electric attracting force by the electret act on the developer on the developer-delivering member, and the electric attracting force by the electret becomes the threshold value and developing conditions are thus set so that adhesion of developer particles to the latent image area (charged area) is caused while adhesion of developer particles to the non-latent-image area (non-charged or weakly charged area) is not caused.

Figure 1:
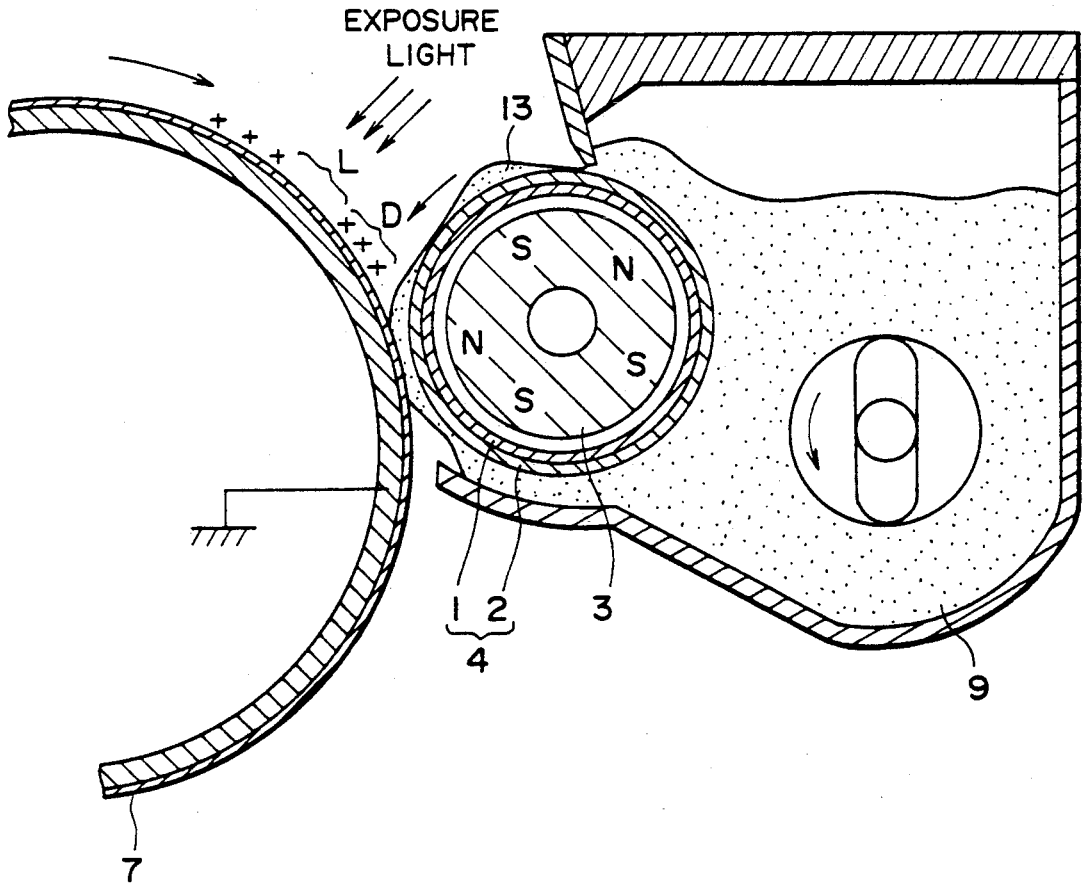
FIG. 1 is a diagram illustrating the principle of the developing process of the present invention.

Referring to FIG. 1 illustrating this principle, one-component type magnetic developer particles 9 are charged, for example, with a negative polarity and form a magnetic brush 13 on a developer-delivering member (developing sleeve) 4. The developing sleeve 4 comprises a sleeve substrate 1 formed of a metal such as aluminum and an electret layer 2 formed on the sleeve substrate 1, and the developing sleeve 4 has magnets 3 disposed in the interior thereof. In this embodiment, the electret layer 2 is positively charged so that the outer surface of the electret layer 2 has a charge polarity reverse to the polarity of the developer particles 9. An electrostatic latent image support 7, such as an electrophotographic photosensitive material, has, on the surface thereof, an electrostatic latent image D charged with a polarity (positive polarity) reverse to the polarity of the developer particles and a non-latent-image area L.

Figure 2:
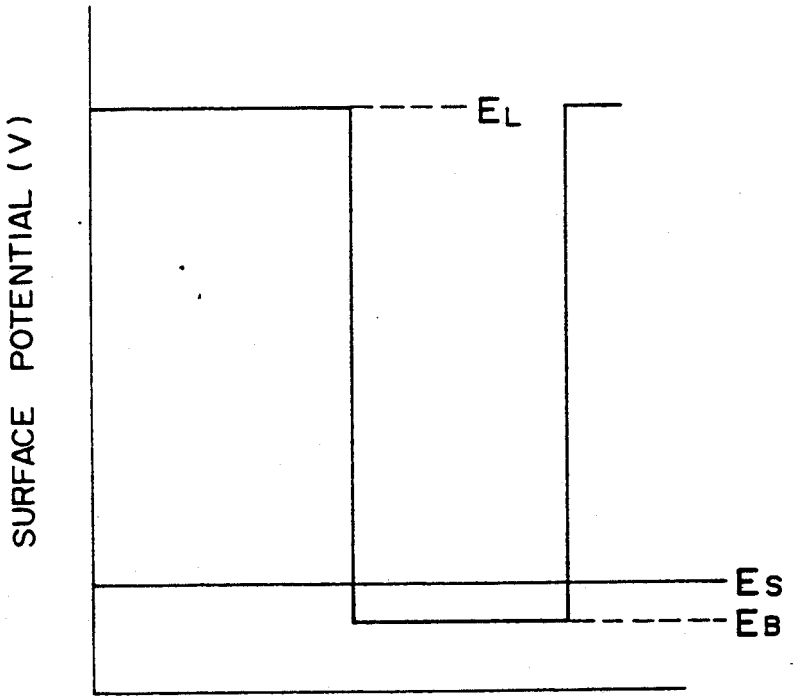
FIG. 2 is a diagram illustrating the relation of the surface potential between the electrostatic latent image and the electret layer.

Supporting that the surface potential of the latent image area of the electrostatic latent image support 7 is $E_L$, the surface potential of the non-latent-image area is $E_B$ and the surface potential of the electret layer is $E_S$, these surface potentials are, in general, as shown in FIG. 2. More specifically, in the latent image area, an electric field corresponding to the potential difference $(E_L - E_S)$ is formed between the developer-delivering member and the electrostatic latent image support, and this electric field acts as the driving force for effecting the development by transfer of the developer particles. On the other hand, in the non-latent-image area, an electric field corresponding to the reverse potential difference $E_S - E_B$ is formed to act as the driving force for preventing the background fogging by inhibiting transfer of the developer particles.

Thus, it will be readily understood that according to the process of the present invention, the electret on the developer-delivering member exerts a function similar to the function attained, when the developing bias voltage is applied. The surface charge by the electret is stably maintained over a period of a long time by the permanent polarization and this function can be permanently attained only by covering the developer-delivering member with the electret. Therefore, the problem of occurrence of fogging by insufficient application of the bias voltage does not arise at all, and special maintenance or inspection for solving this problem is not necessary at all. Moreover, it is not necessary to build the developer-delivering member in the machine in the electrically insulated state or to arrange various electric parts, with the result that prominent advantages, such as reduction of the weight of the apparatus, simplification of the structure of the apparatus and reduction of the cost, can be attained.

Of course, in the case where the surface potential ($E_S$) of the electret is not sufficiently high or where adjustment of $E_S$ is desirable, a bias power source can be connected in parallel to the electret layer. Also in this case, it should be understood that a bias power source having such a low voltage as for the adjustment is sufficient.

According to the present invention, by using a developer-delivering member having an electret layer with a specific charge polarity on the surface, the developer particles having the same polarity as that of the surface charge of the electret are excluded from the magnetic brush on the delivering member before the development. As the result, the background fog density can be drastically reduced. This is another advantage attained by the present invention.

In the above-mentioned developing process, it is preferred that at the development, the effective fog-controlling field intensity ratio (A), define by the following formula (1), be in the range of from 0.01 to 0.6, especially from 0.02 to 0.15:

$$A = \frac{E_S - E_B}{E_L - E_B} \quad (1)$$

wherein $E_S$, $E_B$ and $E_L$ are as defined above.

In general, if the effective fog-controlling field intensity ratio (A) is too low and below the above range, background fogging tends to occur at the development. If the intensity ratio (A) is too high and exceeds the above range, the image density tends to decrease.

In the above-mentioned developing process, as the magnetic developer, there can be used not only a two-component type magnetic developer comprising a magnetic carrier and an electroscopic toner but also a one-component type magnetic developer comprising an electroscopic toner containing a magnetic powder. Any of known developers of these types can be used.

For example, in the two-component type developer, it is preferred that the toner/magnetic carrier mixing weight ratio be in the range of from 1/99 to 10/90, especially from 2/98 to 5/95, though the preferred mixing ratio differs to some content according to the physical properties of the two components. For example, toners and magnetic carriers disclosed in the specification of U.S. Pat. No. 4,949,127 can be used.

A one-component type magnetic developer containing 30 to 70% by weight, especially 40 to 60% by weight, of a magnetic powder based on the toner is preferably used. For example, magnetic powders and toners disclosed in the specification of U.S. Pat. No. 4,401,741 can be used.

If the effective fog-controlling electric field intensity ratio (A) is set within the above-mentioned range, the developing process of the present invention can be applied to the development using a non-magnetic developer. In this case, holding of the charged developer by the developer-delivering member is accomplished by the electrostatic attracting force, and therefore, magnets need not particularly be used. So-called contact development or non-contact development is performed at a predetermined development position. The above-mentioned one-component type magnetic developer, from which the magnetic powder has been removed, can be used as the non-magnetic developer.

Developing Apparatus Using Magnetic Developer

Figure 3:
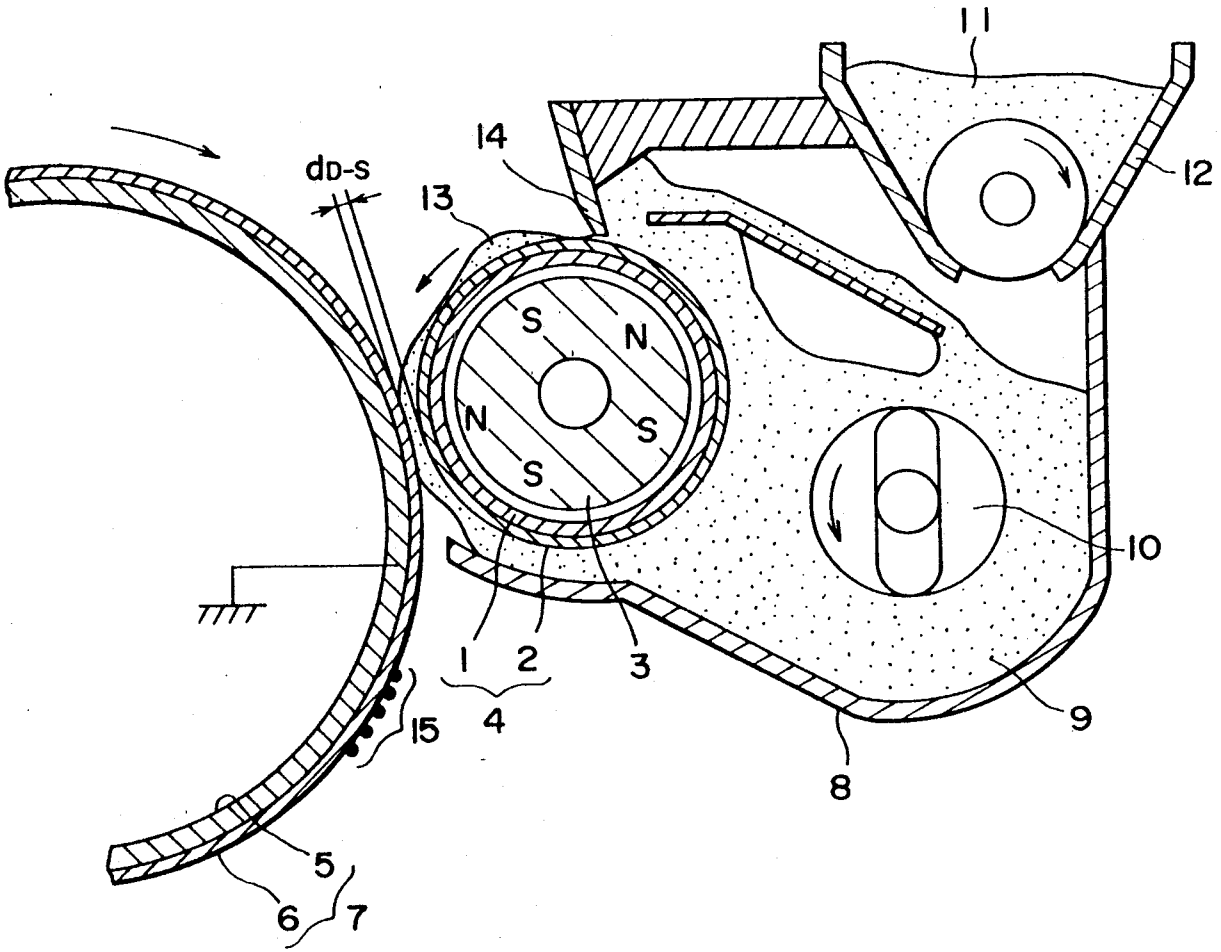
FIG. 3 is a diagram illustrating a developing apparatus of the present invention which is preferably used for carrying out the magnetic brush developing process of the present invention.

Referring to FIG. 3 showing the developing apparatus preferably used for carrying out the magnetic brush development according to the present invention, an electret layer 2 is coated on the surface of a sleeve substrate 1 composed of a non-magnetic material such as aluminum, whereby a developing sleeve 4 is constructed. A magnet roll 3 having a plurality of magnet poles N and S is disposed within the sleeve substrate 1. This combination of the developing sleeve 4 and the magnet 3 may be of either a sleeve-rotating/magnet-fixed type or a sleeve-fixed/magnet-rotating types. Namely, it is sufficient if magnetic brushes formed on the sleeve can be delivered.

A photosensitive drum 7 comprising a substrate 5 and a photographic photosensitive layer 6 formed on the substrate 5 is arranged separately from the developing sleeve 4 by a minute distance $d_{D-S}$. Also this photosensitive drum 7 is rotatably supported on the machine frame (not shown) of the copying machine, as is the developing sleeve 4. In order to prevent formation of brush marks, it is preferred that the developing sleeve 4 and the photosensitive drum 7 be driven in the same direction at the nip position (rotation directions are reverse to each other). However, no particular disadvantage is brought about even if the sleeve 4 and drum 7 are driven in reverse directions at the nip position.

The developing sleeve 4 is located at the opening of a developing device 8, and a mixing stirrer 10 for a magnetic developer 9 (a two-component type magnetic developer or one-component type magnetic developer) is arranged within this developing device 8 and a supply mechanism 12 for supplying developer particles 11 is arranged above the mixing stirrer 10. The magnetic developer 9 is mixed and stirred by the mixer 10 and the developer particles are frictionally charged, and then, the developer particles are supplied to the developing sleeve 4 to form a magnetic brush 13 on the surface of the developing sleeve 4. The earing length of the magnetic brush 13 is adjusted by a brush-cutting blade 14. Then, the length-adjusted magnetic brush 13 is delivered to the nip position between the sleeve 4 and the electrophotographic photosensitive layer 6 to develop the electrostatic latent image with the developer particles and form a toner image 15 on the photosensitive layer 6.

As the photosensitive material for the photosensitive layer 6, there can be used photosensitive materials customarily used for the electrophotography, for example, a selenium photosensitive material, an amorphous silicon photosensitive material, a zinc oxide photosensitive material, a cadmium selenide photosensitive material, a cadmium sulfide photosensitive material, and various organic photosensitive materials.

The flux density of the magnet pole of the magnet 3 in developing sleeve 4 is preferably relatively low, so far as carrier dragging is not caused. More specifically, it is preferred that this flux density be 400 to 1200 gauss, especially 500 to 1000 gauss. Preferably, the revolution number of the developing sleeve is relatively large, so long as scattering of the toner is not caused. More specifically, it is preferred that the peripheral speed of the developing sleeve be 4 to 100 cm/sec, especially 5 to 80 cm/sec.

Preferably, the distance $d_{D-S}$ between the developing sleeve 4 and the photosensitive layer 6 is 0.5 to 3.5 mm in case of the two-component type developer and 0.1 to 1.0 mm in case of the one-component type developer.

Electret Layer

According to the present invention, if an electret having a polarity reverse to the charge polarity of the developer particles is used for the electret layer 2, an image having a high density can be formed while preventing occurrence of background fogging.

Any of organic and inorganic film-forming materials capable of permanent electric polarization can be used as the electret material. However, in view of easiness of formation of an electret and also in view of easiness of formation of a coating, various polymeric materials are preferably used. For example, there are preferably used olefin resins such as polyethylene, polypropylene, an ethylene/butene copolymer, an ion-crosslinked olefin copolymer and an ethylene/acrylic copolymer, fluorine-containing resins such as polyvinyl fluoride, polyvinylidene fluoride, a vinyl fluoride/vinylidene fluoride copolymer, a tetrafluoroethylene resin (PTFE), a tetrafluoroethylene/perfluoroalkoxyethylene copolymer resin (PFA resin) and a tetrafluoroethylene/hexafluoropropylene copolymer resin (FEP resin), chlorine-containing resins such as polyvinyl chloride and a chlorinated polyolefin, thermoplastic polyesters such as polyethylene terephthalate, polyethylene naphthalate and polybutylene terephthalate, polyamides such as nylon 6, nylon 12, nylon 6,6 and nylon 6,10, acrylic resins, and mixtures of two or more of the foregoing resins, though polymeric materials that can be used in the present invention are not limited to those exemplified above. Of these polymeric materials, fluorine-containing resins such as PTFE resins, PFA resins and FEP resins are especially preferably used because they have a good change-retaining property and a high durability.

The electret can be formed by any of known processes such as the thermal electretization process, the electro-electretization process, the radio-electretization process and the photo-electretization process, and an appropriate process can be selected and used according to the kind of the polymer used. For the above-mentioned polymers, especially the fluorine-containing resins, the thermal electretization process and electro-electretization process can be advantageously applied.

The thickness of the electret layer 2 is not particularly critical, but it is generally preferred. that the thickness of the electret layer 2 be 0.005 to 2 mm, especially 0.01 to 0.1 mm.

In order to produce a sufficient electrostatic attracting force, it is preferred that the charge density of the electret layer 2 be in the range of from $10^{-11}$ to $2\times10^{-7}$ C/cm$^2$, and in the case where a selenium photosensitive material is used, it is especially preferred that the charge density of the electret layer 2 be in the range of from $10^{-9}$ to $10^{-7}$ C/cm$^2$. Furthermore, in the case where an organic photosensitive material is used it is preferred that the charge density of the electret layer 2 be in the range of from $10^{-8}$ to $1.5\times10^{-7}$ C/cm$^2$.

In the developing apparatus of the present invention, it is important that the charge density of the electret layer 2 should be set according to the electrophotographic characteristics of the used photosensitive material, so that the fog-controlling charge density ratio (D), defined by the following formula (2):

$$D = \frac{\delta - \delta_B}{\delta_L - \delta} \tag{2}$$

wherein $\delta$ represents the charge density (C/cm$^2$) of the electret layer 2, $\delta_L$ represents the surface charge density (C/cm$^2$) of the latent-image area of the photosensitive material, and $\delta_B$ represents the charge density (C/cm$^2$) of the non-latent-image area, is in the range of from 0.01 to 2.0, especially from 0.02 to 1.9.

As described in detail hereinbefore, in the developing apparatus of the present invention, the development is preferably carried out under conditions where the fog-controlling electric field intensity ratio defined by the above-mentioned formula (1) is within the above-mentioned range. The surface potential $E_L$ of the latent image area and the surface potential $E_B$ of the non-latent-image area in the photosensitive material, which define this electric field intensity ratio (A), are ordinarily set within certain ranges according to the kind of the photosensitive material and the conditions for forming an electrostatic latent image, for example, the charging voltage and the light exposure conditions. Since $E_L$, $E_B$ and $E_S$ are values determined by $\delta_L$, $\delta_B$ and $\delta$, respectively, it will be readily understood that the values of are very important for setting the conditions where the electric field intensity ratio (A) represented by formula (1) is in the above-mentioned range. Namely, if the charge density of the electret layer 2 is set so that the above requirement of the formula (2) is satisfied, under ordinarily adopted developing conditions, it becomes possible for the electric field intensity ratio (A) of the formula (1) to satisfy the above requirement, whereby good development can be attained. More specifically, in the case where the charge density ratio (D) defined by the formula (2) is in the above-mentioned range, the electric field intensity between the non-latent-image area of the photosensitive layer 6 and the electret layer 2 is sufficiently lower than the field intensity between the latent-image area of the photosensitive layer 6 and the electric layer 2, and as the result, background fogging can be effectively controlled and an image having a high density can be formed. For example, if the charge density ratio (D) is lower than 0.01, background fogging is caused, and if the charge density ratio (D) is higher than 2.0, the image density is disadvantageously reduced.

It should be understood that in order to maintain the charge density ratio (D) within the above-mentioned range, the respective surface potentials should satisfy the requirement of $\delta_B<\delta<\delta_L$ as illustrated in FIG. 2.

With reference to typical instances of the photosensitive material, that is, selenium (Se) photosensitive material and organic photosensitive material (OPC)(DC-1605 supplied by Mita Kogyo), preferred ranges of $E_S$, $\delta$, A and D, relative to $E_L$, $\delta_L$, and $E_B$, $\delta_B$ are shown in Table 1 given below.

TABLE 1

| | Se | OPC |
|---|---|---|
| $E_L$ | 600 to 800 | 600 to 800 |
| $\delta_L$ | $6.0\times10^{-8}$ to $8.0\times10^{-8}$ | $9.0\times10^{-8}$ to $1.3\times10^{-7}$ |
| $E_B$ | 20 to 50 | 100 to 250 |
| $\delta_B$ | $2.0\times10^{-9}$ to $5.0\times10^{-9}$ | $1.6\times10^{-8}$ to $4.1\times10^{-8}$ |
| $E_S$ | 30 to 300 | 150 to 300 |
| $\delta$ | $5.5\times10^{-9}$ to $4.6\times10^{-8}$ | $3.7\times10^{-8}$ to $4.6\times10^{-8}$ |
| A | 0.013 to 0.5 | 0.100 to 0.5 |

TABLE 1-continued

| | Se | OPC |
|---|---|---|
| O | 0.04 to 0.47 | 0.04 to 0.68 |

In the present invention, it is preferred that the critical surface tension of the electret layer 2 be lower than 31 dyne/cm, especially lower than 25 dyne/cm. If the critical surface tension of the electret layer 2 exceeds this range, the quantity of the developer adhering physically to the sleeve surface increases, and fogging is sometimes caused.

Furthermore, it is preferred that the surface roughness Rz (average surface roughness) be adjusted to at least 0.02 μm, especially at least 0.022 μm. If the surface roughness Rz is smaller than 0.02 μm, slip of the developer is readily caused on the sleeve and the amount of the delivered developer becomes insufficient, resulting in reduction of the image density.

In the present invention, formation of the electret layer 2 on the surface of the developing sleeve is accomplished by forming a layer of a non-electretized polymer film on the surface of the developing sleeve and electretizing this polymer film layer by means as mentioned hereinbefore. Furthermore, an electretized film can be bonded to the surface of the developing sleeve by using an appropriate adhesive. The electretized film used in this case can be prepared by corona charging. For example, an electretized film is prepared by irradiating a polymer film, to be electretized, with positive or negative charges by using charge irradiation means such as a blade electrode or a needle electrode, bringing the irradiated surface into contact with electricity-removing means such as an electricity-removing brush to remove excessive unstable charges present on the surface, and performing the charge irradiation operation and electricity-removing operation alternately and repeatedly. The voltage applied to the charge irradiation means is selected in the range of 4 to 10 KV, especially 5 to 9 KV, according to the intended charge density, the charge irradiation operation and electricity-removing operation can be performed continuously and effectively by bonding a polymer film, to be electretized, to a cylinder and rotating the cylinder.

In the present invention, the above-mentioned electret layer 2 can be constructed by a laminate structure comprising a plurality of layers. This embodiment is different from the foregoing embodiment only in that an electret layer 2B is further formed on an electret layer 2A, as shown in FIG. 4.

Figure 4:
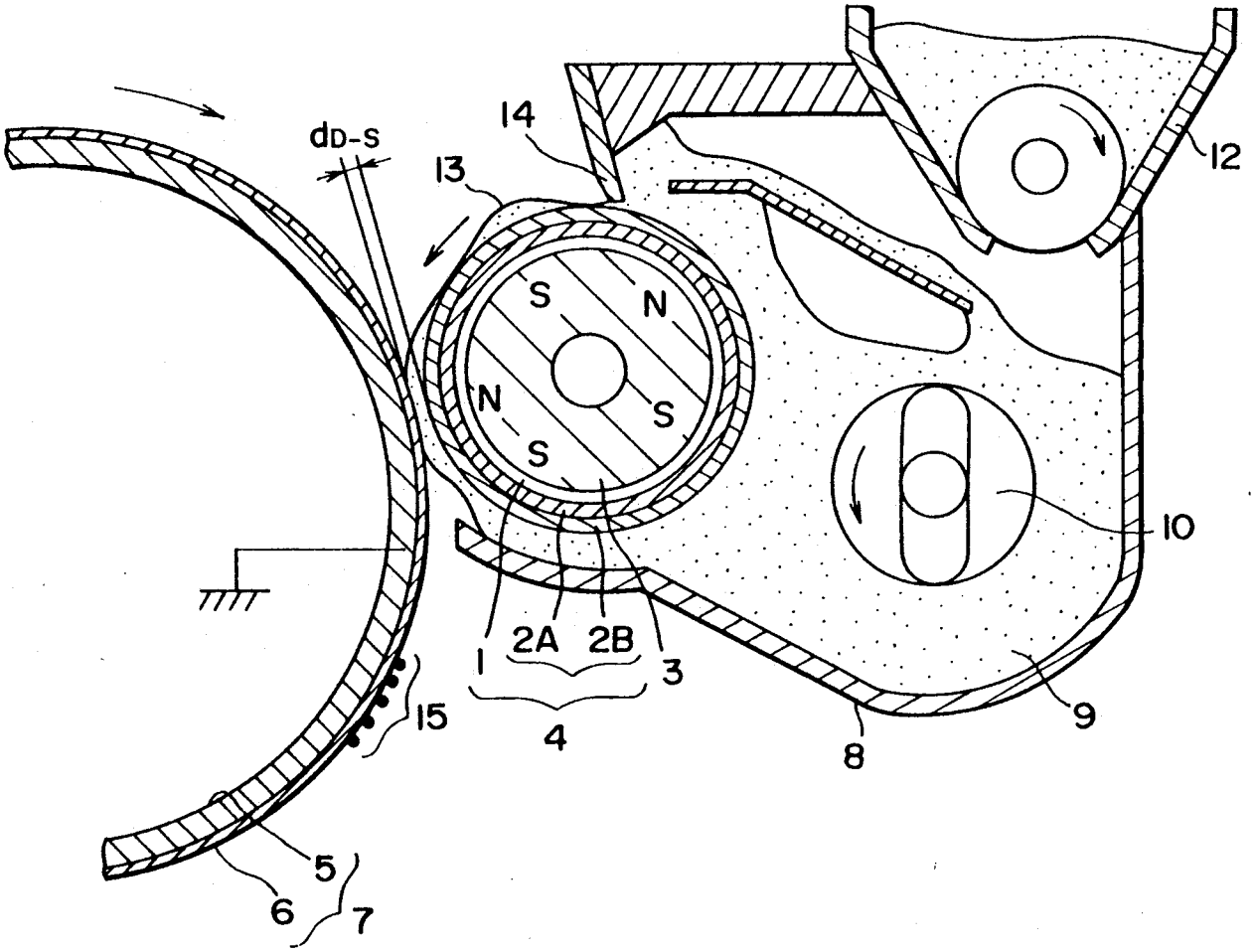
FIG. 4 is a diagram illustrating another developing apparatus of the present invention.

The apparatus shown in FIG. 4 is advantageous in that the charge-retaining stability of the surface electret layer 2B is improved. In this embodiment, the polarities of charges of the surface electret layer 2B and inner electret layer 2A may be the same or different. In general, however, the same polarities are preferable.

In this embodiment, it is preferred that the thickness and charge density of each of the electret layers 2A and 2B be in the above-mentioned ranges, and it also is preferred that the charge density of the surface electret layer be set so that the fog-controlling charge density ratio (D) is within the above-mentioned range, and that the average surface roughness Rz and critical surface tension of the surface electret layer 2B be within the above-mentioned ranges.

Moreover, in the present invention, it is especially preferred that an aluminum vacuum deposition layer (not shown) be formed on any of the electret layers 2A and 2B. For example, an aluminum vacuum deposition layer is preferably formed on the sleeve side of the electret layer 2A. If the aluminum vacuum deposition layer is thus formed, the charge-retaining stability of the surface electret layer 2B can be further improved.

Still further, according to the present invention, a protecting dielectric layer can be formed on the electret layer 2. This embodiment will now be described with reference to FIG. 4. In the description given below, the layer 2B represents a protecting dielectric layer. In this embodiment, since direct contact of developer particles with the electret layer 2A, attenuation of the surface potential or attenuation of the charge density leakage of the charge through the charged developer particles can be effectively prevented, and the capacity of delivering the charged developer and the supporting selectivity of particles charged with a specific polarity can be maintained at very high levels.

In the developing apparatus according to the present embodiment, the charged developer particles are attracted by the external electric field formed through the protecting dielectric layer 2B based on the surface potential of the electret layer 2A.

Figure 5:
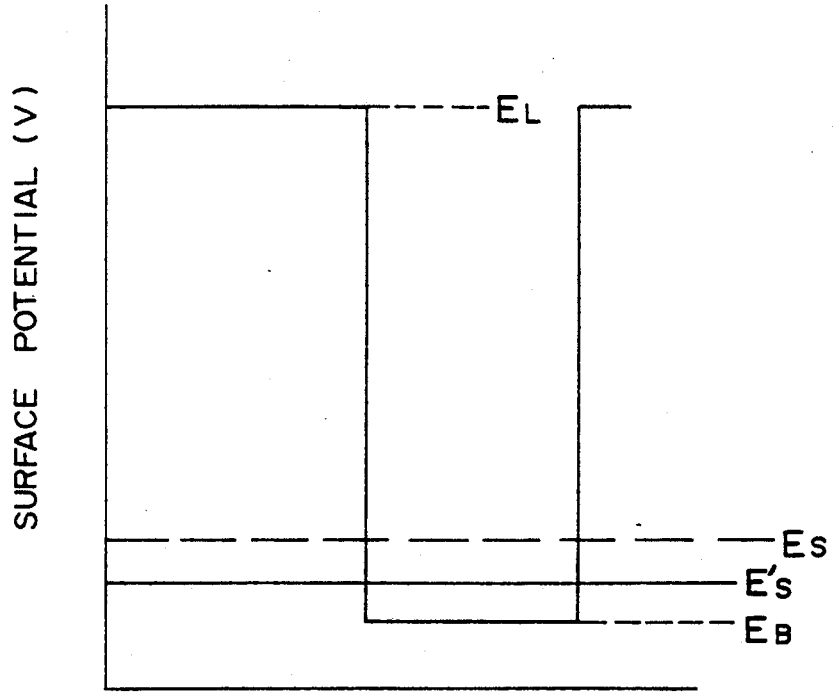
FIG. 5 is a diagram illustrating the relation of the surface potential among the electrostatic latent image support, protecting dielectric layer and electret layer in the developing apparatus shown in FIG. 4.

In this embodiment, the surface potential $E_L$ of the latent-image area of the electrostatic latent image support 7, the surface potential $E_B$ of the non-latent-image area and the surface potential $E'_S$ of the protecting dielectric layer (relation of $E_S > E'_S$ is always established between $E'_S$ and the surface potential $E_S$ of the electret per se) are ordinarily in the state as shown in FIG. 5.

Namely, between the developer-delivering member and the electrostatic latent image support, an electric field of a potential difference of $E_L - E'_S$ is formed in the latent-image area, and this electric field acts as the driving force of delivering the developer particles to effect the development. On the other hand, a reverse electric field of a potential difference of $E'_S - E_B$ is formed in the non-latent-image area, and this electric field acts as the driving force for inhibiting transfer of the developer particles to prevent background fogging.

More specifically, in the case where the developer particles are directly attracted and held onto the dielectric layer, the surface potential $E_S$ is attenuated, and hence, the potential difference of $E_S - E_B$ is reduced and background fogging is readily caused. However, according to the present embodiment, by forming the protecting dielectric layer on the electret layer, reduction of $E_S$ and in turn, reduction of $E'_S$ can be controlled to such low levels as can be neglected, with the result that occurrence of background fogging can be prevented over a long period of time.

Accordingly, the values $E_S$ and $\delta$ in the formulae (1) and (2) defining the electric field intensity ratio (A) and charge density ratio (D) are values based on this protecting dielectric layer.

Incidentally, the above-mentioned protecting dielectric layer can also be formed on a laminated electret layer as mentioned above.

Adjustment Length of Magnetic Brush

In the developing apparatus as shown in FIGS. 3 and 4, it is preferred that the earing length of the magnetic brush on the developing sleeve 4 be 0.5 to 3.0 mm in case of a two-component type magnetic developer and 0.1 to 1.0 mm in case of a one-component type developer, though the preferred earing length differs to some extent according to the kind of the developer.

In the developing apparatus shown in FIGS. 3 and 4, an electret layer (not shown) can also be formed on the surface of the earing length-adjusting blade 14. When the conventional earing length-adjusting blade is used, only the earing length of the magnetic brush is physically regulated, but if an electret layer is formed on the surface of the blade 14, an electrostatic force acts on the magnetic brush of the developer passing though the electret layer-formed blade 14, and the density of the developer in the magnetic brush is uniformly adjusted within a certain range and a good image having no unevenness can be obtained. In this case, if the polarity of the electret layer formed on the surface of the blade 14 is the same as the polarity of the developer, an electric repulsive force acts on the magnetic brush, and if both the polarities are the same, an electric attractive force acts on the magnetic brush. It is generally preferred that the polarity of the electret layer be the same as the polarity of the developer. It also is preferred that the thickness of this electret layer be 0.01 to 2.0 mm and the charge density (absolute value) be $5\times10^{-10}$ to $2\times10^{-7}$ C/cm$^2$.

In the developing apparatus shown in FIGS. 3 and 4, the development can be accomplished without applying a developing bias voltage, but there can be adopted a method in which an auxiliary bias power source is disposed and the development is carried out while applying a bias voltgae.

Figure 6:
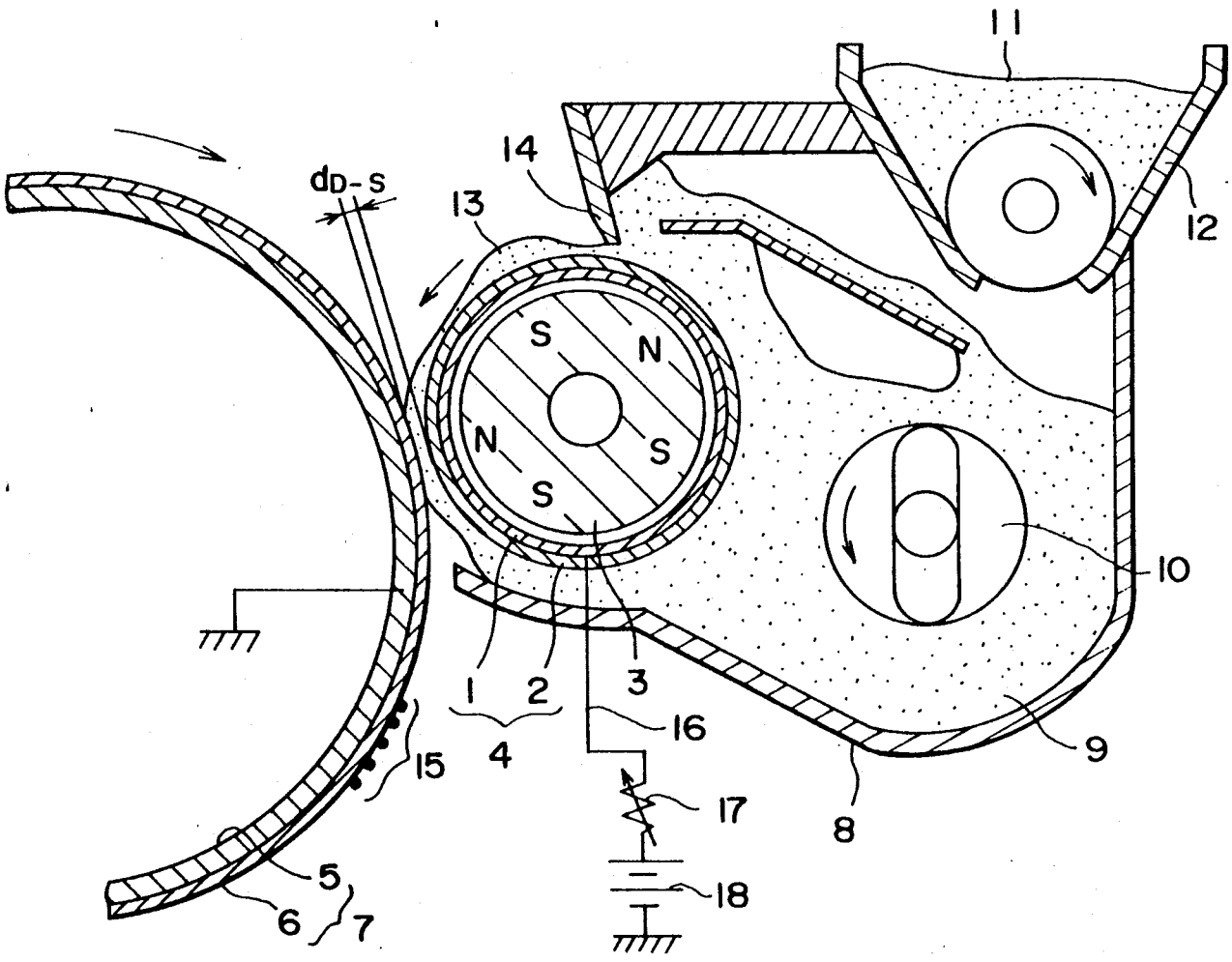
FIG. 6 is a diagram illustrating still another developing apparatus of the present invention.

For example, referring to FIG. 6 illustrating an embodiment where an auxiliary bias power source is disposed in the developing apparatus shown in FIG. 3, an auxiliary bias power source 18 is connected to the sleeve substrate 1 through a line 16, and a variable resistor 17 is connected to this auxiliary bias power source 18 to adjust the auxiliary bias voltage to an optional value. The structure and arrangement of other members are the same as in the apparatus shown in FIG. 3. According to this embodiment, since the auxiliary bias voltage $E_V$ is connected in series to the electret surface potential $E_S$, by adjusting $E_V$, the effective fog-controlling electric field intensity ratio (A) defined by the following formula:

$$A = \frac{E_S' - E_B}{E_L - E_B} \quad (1')$$

wherein E' is not equal to $E_S+E_V$ can be set at an optional value.

Also in the apparatus shown in FIG. 4, the development can be carried out whie applying a bias voltage if an auxiliary bias power source is disposed as shown in FIG. 6.

Developing Apparatus Using Non-Magnetic Developer

Figure 7:
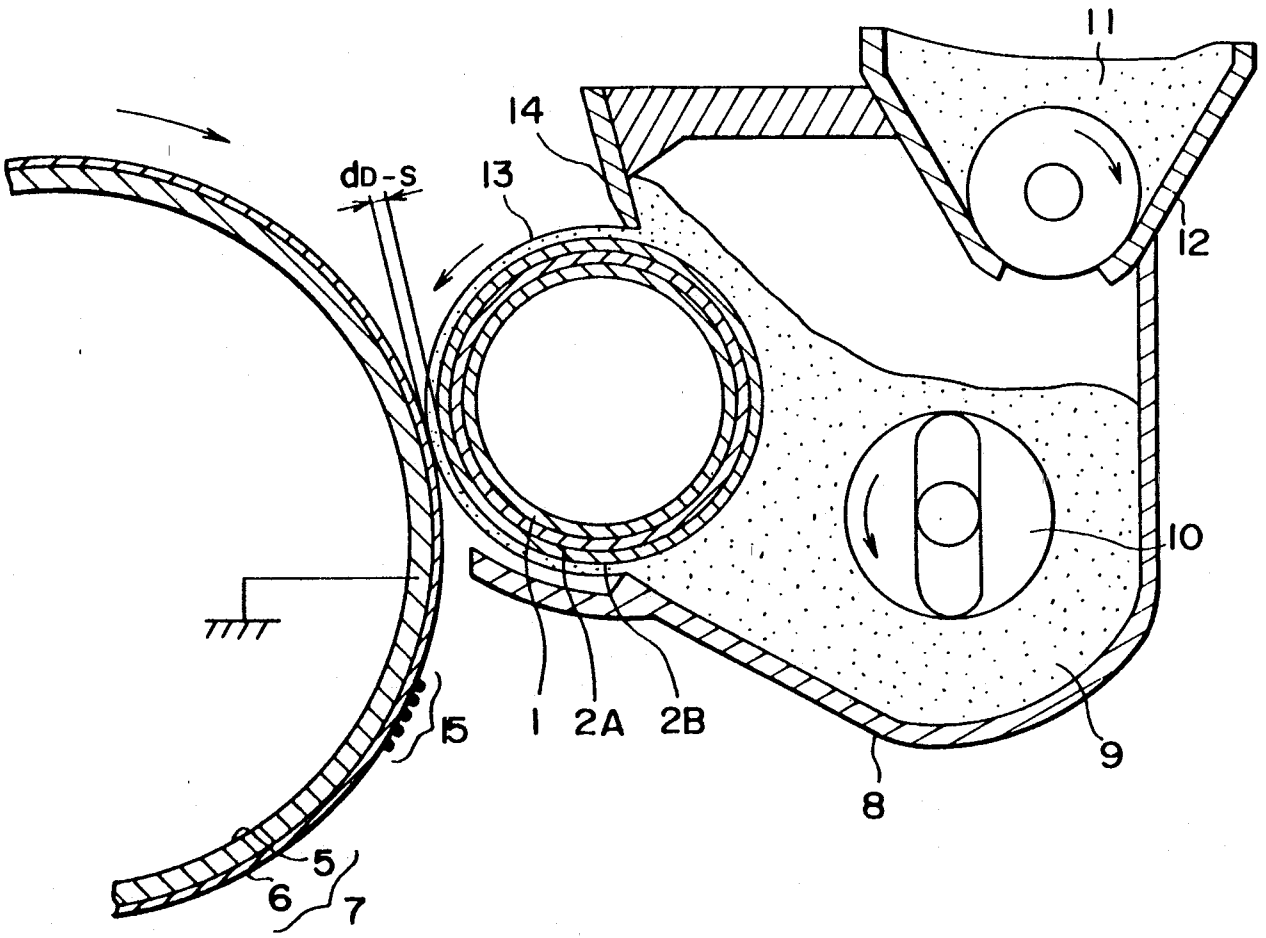
FIG. 7 is a diagram illustrating an apparatus constructed by improving the developing apparatus shown in FIG. 4 so that the apparatus can be applied to the developing process using a non-magnetic developer.

The above-mentioned developing apparatus can also be applied to the developing process using a non-magnetic developer. In this case, since the non-magnetic developer is held on the electret layer 2 only by the electrostatic attracting force, magnets need not be disposed within the developing sleeve 4. A developing apparatus constructed by improving the apparatus shown in FIG. 4 so that the apparatus can be applied to this developing process is illustrated as an example in FIG. 7.

EXAMPLES

The present invention will now be described in detail with reference to the following examples.

EXAMPLE 1

An FEP resin having a thickness of 0.025 mm was coated on the surface of a developing sleeve of aluminum having an outer diameter of 38 mm, and the resin was electretized to form an electret layer having a surface potential ($E_S$) of 100 V and a charge density ($\delta$) of $7.4\times10^{-8}$ C/cm$^2$. The developing sleeve was attached to an electrophotographic copying machine (Model DC-112C supplied by Mita Kogyo) comprising an amorphous selenium photosensitive material, and magnetic brush development, transfer and fixation were carried out without applying a developing bias voltage.

The physical properties and the like of the electret layer and the developing conditions were as described below.

Surface potential ($E_S$) of electret layer: 100 V
Charge density ($\delta$) of electret layer: $7.4\times10^{-9}$ C/cm$^2$
Critical surface tension of electret layer: 17 dyne/cm
Average surface roughness of electret layer: 0.025 $\mu$m
Thickness of electret layer: 0.025 mm
Surface potential ($E_L$) of photosensitive layer: 700 V
Surface charge density ($\delta_L$) of photosensitive layer: $7.0\times10^{-8}$ C/cm$^2$
Potential ($E_B$) of non-latent-image area: 40 V
Charge density ($\delta_B$) of non-latent-image area: $4.0\times10^{-9}$ C/cm$^2$
Effective fog-controlling electric field intensity ratio (A): 0.091
Effective fog-controlling charge density ratio (D): 0.05
Peripheral speed of photosensitive layer: 13.5 cm/sc
Peripheral speed of developing sleeve: 27.0 cm/sec
Photosensitive layer/developing sleeve rotation system: forward direction
Magnetic pole in sleeve: 800 gauss
Photosensitive layer/sleeve distance $d_{D-S}$: 1.0 mm
Earing length of magnetic brush: 1.0 mm
Developer: two-component type developer
Magnetic carrier/toner mixing ratio: 96/4

The image density of the obtained copy was 1.35 and the fog density was 0.002.

EXAMPLE 2

An FEP resin having a thickness of 0.0125 mm was coated on the surface of a developing sleeve of aluminum having an outer diameter of 31 mm, and the resin was electretized to form an electret layer having a surface potential ($E_S$) of 250 V and a charge density ($\delta$) of $3.7\times10^{-8}$ C/cm$^2$. This developing sleeve was attached to an electrophotographic copying machine (Model DC-1605 supplied by Mita Kogyo) comprising an organic photosensitive material, and magnetic brush development, transfer and fixation were carried out without applying a developing bias voltage.

The physical properties and the like of the electret layer and the developing conditions were as described below.

Surface potential ($E_S$) of electret layer: 250 V
Charge density ($\delta$) of electret layer: $3.7\times10^{-8}$ C/cm$^2$
Critical surface tension of electret layer: 19 dyne/cm
Average surface roughness of electret layer: 0.35 $\mu$m
Thickness of electret layer: 0.025 mm
Surface potential ($E_L$) of photosensitive layer: 650 V
Surface charge density ($\delta_L$) of photosensitive layer: $1.1\times10^{-7}$ C/cm$^2$ Potential ($E_B$) of non-latent-image area: 200 V
Charge density ($\delta_B$) of non-latent-image area: $3.3\times10^{-8}$ C/cm$^2$
Effective fog-controlling electric field intensity ratio (A): 0.1
Effective fog-controlling charge density ratio (D): 0.06
Peripheral speed of photosensitive layer: 15 cm/sc
Peripheral speed of developing sleeve: 38 cm/sec
Photosensitive layer/developing sleeve rotation system: forward direction
Magnetic pole in sleeve: 800 gauss
Photosensitive layer/sleeve distance $d_{D-S}$: 1.0 mm
Earing length of magnetic brush: 1.0 mm
Developer: two-component type developer
Magnetic carrier/toner mixing ratio: 96/4

The image density of the obtained copy was 1.40 and the fog density was 0.003.

EXAMPLE 3

An electret layer was formed on the surface of the developing sleeve in the same manner as described in Example 1. By using this developing sleeve, magnetic brush development, transfer and fixation were carried out in the same manner as described in Example 1 except that some of the developing conditions were changed.

The physical properties and the like of the electret layer and the developing conditions were as described below.

Surface potential ($E_S$) of electret layer: 100 V
Charge density ($\delta$) of electret layer: $7.4\times10^{-9}$ C/cm$^2$
Critical surface tension of electret layer: 17 dyne/cm
Average surface roughness of electret layer: 0.025 μm
Thickness of electret layer: 0.025 mm
Surface potential ($E_L$) of photosensitive layer: 600 V
Surface charge density ($\delta_L$) of photosensitive layer: $6.0\times10^{-8}$ C/cm$^2$
Potential ($E_B$) of non-latent-image area: 35 V
Charge density ($\delta_B$) of non-latent-image area: $3.4\times10^{-9}$ C/cm$^2$
Effective fog-controlling electric field intensity ratio (A): 0.11
Effective fog-controlling charge density ratio (D): 0.08
Peripheral speed of photosensitive layer: 13.5 cm/sec
Peripheral speed of developing sleeve: 27.0 cm/sec
Photosensitive layer/developing sleeve rotation system: forward direction
Magnetic pole in sleeve: 800 gauss
Photosensitive layer/sleeve distance $d_{D-S}$: 1.0 mm
Earing length of magnetic brush: 1.0 mm
Developer: two-component type developer
Magnetic carrier/toner mixing ratio: 96/4

The image density of the obtained copy was 1.38 and the fog density was 0.002.

EXAMPLE 4

An FEP resin having a thickness of 0.0125 mm was coated on the surface of a developing sleeve of aluminum having an outer diameter of 31 mm, and the resin was electretized to form an electret layer having a surface potential ($E_S$) of 250 V and a charge density ($\delta$) of $3.8\times10^{-8}$ C/cm$^2$. This developing sleeve was attached to an electrophotographic copying machine (Model DC-1605 supplied by Mita Kogyo) comprising an amorphous selenium photosensitive material, and magnetic brush development, transfer and fixation were carried out without applying a developing bias voltage.

The physical properties and the like of the electret layer and the developing conditions were as described below.

Surface potential ($E_S$) of electret layer 250 V
Charge density ($\delta$) of electret layer: $3.8\times10^{-9}$ C/cm$^2$
Critical surface tension of electret layer: 19 dyne/cm
Average surface roughness of electret layer: 0.31 μm
Thickness of electret layer: 0.125 mm
Surface potential ($E_L$) of photosensitive layer: 615 V
Surface charge density ($\delta_L$) of photosensitive layer: $1.0\times10^{-7}$ C/cm$^2$
Potential ($E_B$) of non-latent-image area: 200 V
Charge density ($\delta_B$) of non-latent-image area: $3.3\times10^{-8}$ C/cm$^2$
Effective fog-controlling electric field intensity ratio (A): 0.22
Effective fog-controlling charge density ratio (D): 0.08
Peripheral speed of photosensitive layer: 15 cm/sec.
Peripheral speed of developing sleeve: 38.0 cm/sec
Photosensitive layer/developing sleeve rotation system: forward direction
Magnetic pole in sleeve: 800 gauss
Photosensitive layer/sleeve distance $d_{D-S}$: 1.0 mm
Earing length of magnetic brush: 1.0 mm
Developer: two-component type developer
Magnetic carrier/toner mixing ratio: 96/4

The image density of the obtained copy was 1.35 and the fog density was 0.003.

EXAMPLE 5

An FEP resin having a thickness of 0.025 mm was coated on the surface of a developing sleeve of aluminum having an outer diameter of 38 mm, and the resin was electretized to form an inner electret layer. Furthermore, an outer electret layer composed of an FEP resin, which had a thickness of 0.05 mm and the same polarity as that of the inner electret layer, was formed on the inner electret layer.

This developing sleeve was attached to an electrophotographic copying machine (Model DC-112C supplied by Mita Kogyo) comprising an amorphous selenium photosensitive material, and magnetic brush development, transfer and fixation were carried out without applying a developing bias voltage.

The physical properties and the like of each electret layer and the developing conditions were as described below.

(Inner Electret layer)

Surface potential ($E_S$) of inner electret layer: 100 V
Charge density ($\delta$) of inner electret layer: $7.4\times10^{-9}$ C/cm$^2$
Thickness of inner electret layer: 0.025 mm (Outer Electret Layer)

Surface potential ($E_S$) of outer electret layer: 200 V
Charge density ($\delta$) of outer electret layer: $7.4\times10^{-9}$ C/cm$^2$
Critical surface tension of electret layer: 17 dyne/cm
Average surface roughness of electret layer: 0.025 μm
Thickness of electret layer: 0.05 mm
Surface potential ($E_L$) of photosensitive layer: 700 V
Surface charge density ($\delta_L$) of photosensitive layer: $7.0\times10^{-8}$ C/cm$^2$
Potential ($E_B$) of non-latent-image area: 40 V
Charge density ($\delta_B$) of non-latent-image area: $4.0\times10^{-9}$ C/cm$^2$
Effective fog-controlling electric field intensity ratio (A): 0.091

Effective fog-controlling charge density ratio (D): 0.05
Peripheral speed of photosensitive layer: 13.5 cm/sec.
Peripheral speed of developing sleeve: 27.0 cm/sec
Photosensitive layer/developing sleeve rotation system: forward direction
Magnetic pole in sleeve: 800 gauss
Photosensitive layer/sleeve distance $d_{D-S}$: 1.0 mm
Earing length of magnetic brush: 1.0 mm
Developer: two-component type developer
Magnetic carrier/toner mixing ratio: 96/4

The image density of the obtained copy was 1.35 and the fog density was 0.003.

EXAMPLE 6

An FEP resin having a thickness of 0.025 mm was coated on the surface of a developing sleeve of aluminum having an outer diameter of 38 mm, and the resin was electretized to form an electret layer (aluminum vacuum-deposited on the inner side). Then, an outer electret layer composed of an FEP resin, which had a thickness of 0.025 mm and the same polarity as that of the inner electret layer, was formed on the inner electret layer.

This developing sleeve was attached to an electrophotographic copying machine (Model DC-112C supplied by Mita Kogyo) comprising an amorphous selenium photosensitive material, and magnetic brush development, transfer and fixation were carried out without applying a developing bias voltage.

The physical properties and the like of each electret layer and the developing conditions were as described below.

(Inner Electret Layer)

Surface potential ($E_S$) of inner electret layer: 100 V
Charge density ($\delta$) of inner electret layer: $7.4\times10^{-9}$ C/cm$^2$
Thickness of inner electret layer: 0.025 mm (Outer Electret Layer)

Surface potential ($E_S$) of outer electret layer: 100 V
Charge density ($\delta$) of outer electret layer: $7.4\times10^{-9}$ C/cm$^2$
Critical surface tension of electret layer: 17 dyne/cm
Average surface roughness of electret layer: 0.27 um
Thickness of electret layer: 0.025 mm
Surface potential ($E_L$) of photosensitive layer: 700 V
Surface charge density ($\delta_L$) of photosensitive layer: $7.0\times10^{-8}$ C/cm
Potential ($E_B$) of non-latent-image area: 40 V
Charge density ($\delta$) of non-latent-image area: $4.0\times10^{-9}$ C/cm$^2$
Effective fog-controlling electric field intensity ratio (A): 0.091
Effective fog-controlling charge density ratio (D): 0.05
Peripheral speed of photosensitive layer: 13.5 cm/sec
Peripheral speed of developing sleeve: 27.0 cm/sec system: forward direction
Magnetic pole in sleeve: 800 gauss
Photosensitive layer/sleeve distance $d_{D-S}$: 1.0 mm
Earing length of magnetic brush: 1.0 mm
Developer: two-component type developer
Magnetic carrier/toner mixing ratio: 96/4

The image density of the obtained copy was 1.30 and the fog density was 0.002.

EXAMPLE 7

The development was carried out in the same manner as described in Example 1 except that an electret layer described below was formed on the surface of the doctor blade for adjusting the earing length of the magnetic brush.

Surface potential: 300 V
Charge density: $1.1\times10^{-8}$ C/cm$^2$
Critical surface tension: 21 dyne/cm
Thickness: 0.05 mm The image density of the obtained copy was 1.36 and the fog density was 0.002. The image density unevenness was smaller than 0.3.

EXAMPLE 8

An FEP resin having a thickness of 2.5 μm was coated on the surface of a developing sleeve of aluminum having an outer diameter of 38 mm, and the resin was electretized to form an electret layer having a surface potential ($E_S$) of 300 V and a charge density ($\delta$) of $2.2\times10^{-8}$ C/cm$^2$. Then, a protecting coating layer of polytetrafluoroethylene having a thickness of 12.5 μm was formed on the electret layer.

This developing sleeve was attached to an improved type of an electrophotographic copying machine (Model DC-112C supplied by Mita Kogyo) comprising an amorphous selenium photosensitive material, and magnetic brush development, transfer and fixation were carried out under the following developing conditions without applying a developing bias voltage.

Surface potential ($E'_S$) of protecting layer: 280 V
Surface potential ($E_L$) of photosensitive layer: 700 V
Potential ($E_B$) of non-latent-image area: 40 V
Peripheral speed of photosensitive layer: 13.5 cm/sec
Peripheral speed of developing sleeve: 27.0 cm/sec
Photosensitive layer/developing sleeve rotation system: forward direction
Photosensitive layer/sleeve distance $d_{D-S}$: 0.2 mm
Earing length of magnetic brush: 0.2 mm
Effective fog-controlling electric field intensity ratio (A): 0.36
Developer: one-component type (styrene/acrylic resin) non-magnetic developer The image density of the obtained copy was 1.36 and the fog density was 0.003.

We claim:

1. An electrophotographic developing process comprising supplying a magnetic developer to a developer-delivering member having magnets disposed in the interior thereof and also having on the surface thereof an electret layer having a polarity reverse to the polarity of developer particles, to form a magnetic brush of the magnetic developer, and bringing the magnetic brush into contact with a support having an electrostatic latent image thereon, to effect the development of the electrostatic latent image, wherein the development is carried out so that the effective fog-controlling field intensity ratio (A) defined by the following formula:

$$A = \frac{E_S - E_B}{E_L - E_B}$$

wherein $E_L$ represents the surface potential of the latent image area in the support having the electrostatic latent image area, $E_B$ represents the surface potential of the non-image area and $E_S$ represents the surface potential of the electret layer, is in the range of from 0.01 to 0.6.

2. A developing process according to claim 1, wherein the contact of the magnetic brush with the electrostatic latent image support is carried out without applying a bias voltage.

3. A developing process according to claim 1, wherein the magnetic developer is a two-component type developer comprising a magnetic carrier and a toner, or a one-component type magnetic toner containing a magnetic powder.

4. An electrophotographic developing process comprising supplying a magnetic developer to a developer-delivering member having magnets disposed in the interior thereof and also having on the surface thereof a laminate comprising a plurality of electret layers having the same or different polarities and having a polarity the same or reverse to the polarity of developer particles, to form a magnetic brush of the magnetic developer, and bringing the magnetic brush into contact with a support having an electrostatic latent image thereon, to effect the development of the electrostatic latent image, wherein the development is carried out so that the effective fog-controlling field intensity ratio (A) defined by the following formula:

$$A = \frac{E_S - E_B}{E_L - E_B}$$

wherein $E_L$ represents the surface potential of the latent image area in the support having the electrostatic latent image area, $E_B$ represents the surface potential of the non-image area and $E_S$ represents the surface potential of the laminate, is in the range of from 0.01 to 0.6.

5. A developing process according to claim 4, wherein the contact of the magnetic brush with the electrostatic latent image support is carried out without applying a bias voltage.

6. A developing process according to claim 4, wherein the magnetic developer is a two-component type developer comprising a magnetic carrier and a toner, or a one-component type magnetic toner containing a magnetic powder.

7. In a developing process wherein a non-magnetic developer is electrically charged and supplied to the surface of a developer-delivering member having an electret layer having a polarity reverse to the charged polarity, then the developer is supplied to the surface of the supporting body having an electrostatic latent image, effecting an electrostatic latent image development, a developing process wherein the development is carried out so that the effective fog-controlling field intensity ratio (A) defined by the following formula:

$$A = \frac{E_S - E_B}{E_L - E_B}$$

wherein $E_L$ represents the surface potential of the latent image area in the support having the electrostatic latent image area, $E_B$ represents the surface potential of the non-image area and $E_S$ represents the surface potential of the electret layer, is in the range of from 0.01 to 0.6.

8. A developing apparatus comprising a support for supporting an electrostatic image thereon, a mechanism for electrically charging a powdery developer and a developer-delivering member for supporting the charged powdery developer thereon and supplying the powdery developer to said support, wherein the developer-delivering member has an electret dielectric layer at least on the surface thereon, and the charge density of the electret dielectric layer is adjusted so that the fog-controlling charge density ratio (D) defined by the following formula:

$$D = \frac{\delta - \delta_B}{\delta_L - \delta}$$

wherein $\delta$ represents the charge density of the electret dielectric layer, $\delta_B$ represents the charge density of the non-image area of said support and $\delta_L$ represents the charge density of the image area of said support, is in the range of from 0.01 to 2.0.

9. A developing apparatus as set forth in claim 8, wherein the surface charge density of the electret layer is $10^{-11}$ to $2\times10^{-7}$ C/cm$^2$.

10. A developing apparatus as set forth in claim 8, wherein the thickness of the electret layer is in the range of from 0.005 to 2 mm.

11. A developing apparatus as set forth in claim 8, wherein the critical surface tension of the electret layer is lower than 31 dine/cm.

12. A developing apparatus as set forth in claim 8, wherein the average surface roughness (Rz) of the electret layer is at least 0.02 μm.

13. A developing apparatus as set forth in claim 8, wherein a plurality of electret layers are arranged to form an electret laminate.

14. A developing apparatus as set forth in claim 13, wherein the bonded surfaces of the electret layers of the electret laminate have the same polarity.

15. A developing apparatus as set forth in claim 13, wherein the electret laminate is formed on a conductive layer.

16. A developing apparatus as set forth in claim 8, wherein the developer is a two-component type or one-component type magnetic developer and the developer-delivering member has magnets disposed in the interior thereof.

17. A developing apparatus as set forth in claim 8, wherein the developer is a non-magnetic developer.

18. An electrophotographic developing apparatus comprising a support for supporting an electrostatic image, a mechanism for electrically charging a powdery developer and a developer-delivering member for supporting the charged powdery developer thereon and applying the charged powdery developer to said support, wherein the developer-delivering member has a laminate structure comprising an electret dielectric layer and a protecting dielectric layer formed on the surface of the electret dielectric layer, and the charge density of the electret dielectric layer is adjusted so that the fog-controlling charge density ratio (D) defined by the following formula:

$$D = \frac{\delta - \delta_B}{\delta_L - \delta}$$

wherein $\delta$ represents the charge density of the electret dielectric layer, $\delta_B$ represents the charge density of the non-image area of said support and $\delta_L$ represents the charge density of the image data of said support, is in the range of from 0.01 to 2.0.

19. A developing apparatus as set forth in claim 18, wherein the outer surface of the electret dielectric layer is charged with a polarity reverse to the polarity of the charge polarity of the particles of the powdery developer.

* * * * *